US008950156B2

(12) United States Patent
Vandehey

(10) Patent No.: US 8,950,156 B2
(45) Date of Patent: Feb. 10, 2015

(54) METHOD FOR MODIFYING WALLS

(71) Applicant: SR Contractors, LLC, Portland, OR (US)

(72) Inventor: Ronald G. Vandehey, Aloha, OR (US)

(73) Assignee: SR Contractors, LLC, Portland, OR (US)

( * ) Notice: Subject to any disclaimer, the term of this patent is extended or adjusted under 35 U.S.C. 154(b) by 24 days.

(21) Appl. No.: 13/647,243

(22) Filed: Oct. 8, 2012

(65) Prior Publication Data

US 2013/0086868 A1 Apr. 11, 2013

Related U.S. Application Data

(60) Provisional application No. 61/545,998, filed on Oct. 11, 2011.

(51) Int. Cl.
*E04G 23/00* (2006.01)
*E04G 23/02* (2006.01)
*E04F 13/00* (2006.01)

(52) U.S. Cl.
CPC ..... *E04F 13/00* (2013.01); *E04G 23/02* (2013.01)
USPC ..... 52/742.13; 52/415; 52/508

(58) Field of Classification Search
CPC ..... E04G 11/20; E04G 11/22; E04G 11/28; E04G 11/30
USPC ..... 249/15, 18, 20; 52/742.13, 479.13, 243, 52/745.2, 508, 364–377, 443–454, 742.1, 52/415; 425/63, 145, 146, 147
See application file for complete search history.

(56) References Cited

U.S. PATENT DOCUMENTS

| | | | | | |
|---|---|---|---|---|---|
| 1,368,131 | A | * | 2/1921 | Fluor | 264/33 |
| 1,989,141 | A | * | 1/1935 | Leonard | 33/648 |
| 2,516,318 | A | * | 7/1950 | Hawes | 425/63 |
| 2,870,627 | A | * | 1/1959 | Garth | 52/749.13 |
| 3,039,164 | A | * | 6/1962 | Kemeny et al. | 425/63 |
| 4,076,778 | A | * | 2/1978 | Whitting | 264/33 |
| 4,342,181 | A | * | 8/1982 | Truesdell | 52/742.13 |
| 4,409,768 | A | * | 10/1983 | Boden | 52/309.4 |
| 4,939,846 | A | * | 7/1990 | Damiano et al. | 33/404 |
| 5,029,426 | A | * | 7/1991 | Larson et al. | 52/745.01 |
| 5,131,201 | A | * | 7/1992 | Larson et al. | 52/583.1 |
| 5,273,693 | A | * | 12/1993 | Rothwell et al. | 264/33 |
| 5,554,392 | A | * | 9/1996 | Gray | 425/64 |
| 5,558,823 | A | * | 9/1996 | Gray | 264/33 |

(Continued)

OTHER PUBLICATIONS

SR Contractors LLC, "Veneer Attachment," 1 p. (Feb. 17, 2011).

(Continued)

*Primary Examiner* — James Ference
(74) *Attorney, Agent, or Firm* — Klarquist Sparkman, LLP

(57) ABSTRACT

In some embodiments, a form assembly is provided with a form member facing an existing wall, to which sheathing panels are attached. The cavity created between the sheathing panels and the existing wall can be filled with a foamable, adhesive material which adheres to the sheathing panels and the existing wall and creates an adhesive connection between them. In some embodiments, the form assembly is vertically adjustable to facilitate the installation of multiple rows of sheathing panels. In some embodiments, the foamable, adhesive material is introduced in successive layers.

17 Claims, 6 Drawing Sheets

(56) References Cited

U.S. PATENT DOCUMENTS

| | | | | |
|---|---|---|---|---|
| 5,634,305 | A * | 6/1997 | Erlanger | 52/235 |
| 6,430,824 | B1 * | 8/2002 | Smith | 33/286 |
| 6,662,516 | B2 * | 12/2003 | Vandehey et al. | 52/407.1 |
| 6,857,234 | B2 * | 2/2005 | Goudreau et al. | 52/243 |
| 6,926,851 | B2 * | 8/2005 | Colavito et al. | 264/33 |
| 7,194,845 | B2 * | 3/2007 | Belleau | 52/745.09 |
| 7,666,334 | B2 * | 2/2010 | Colavito et al. | 264/33 |
| 2002/0108347 | A1 * | 8/2002 | Vandehey et al. | 52/742.13 |
| 2003/0091672 | A1 * | 5/2003 | Colavito et al. | 425/63 |
| 2003/0146365 | A1 * | 8/2003 | Miller et al. | 249/3 |
| 2005/0210823 | A1 * | 9/2005 | Colavito et al. | 52/745.2 |
| 2005/0226952 | A1 * | 10/2005 | Colavito et al. | 425/63 |
| 2005/0268818 | A1 * | 12/2005 | Colavito et al. | 106/661 |
| 2012/0096806 | A1 * | 4/2012 | Fransen | 52/749.14 |
| 2013/0086868 | A1 * | 4/2013 | Vandehey | 52/742.13 |

OTHER PUBLICATIONS

Yana, Masonry Advisory Council, "Think Systems," downloaded from http://web.archive.org/web/20080510143552/http://www.maconline.org/tech/design/thinksystems/thinksystems.html, 3 pp. (document not dated, archive date May 10, 2008).

Yana, Masonry Advisory Council, "Think Systems," downloaded from http://web.archive.org/web/20080725090625/http:/www.maconline.org/tech/design/thinksystems/brick-wood_stud-wall/brick-wood_stud-wall.html, 3pp. (document not dated, archive date Jul. 25, 2008).

Yana, Masonry Advisory Council, "Think Systems," downloaded from http://web.archive.org/web/20060923000645/http:/www.maconline.org/tech/design/thinksystems/thinksystems.html, 8pp. (document not dated, archive date Sep. 23, 2006).

* cited by examiner

METHOD FOR MODIFYING WALLS

CROSS REFERENCE TO RELATED APPLICATION

This application claims the benefit of U.S. Provisional Patent Application No. 61/545,998, filed Oct. 11, 2011, which is hereby incorporated by reference.

FIELD

The present disclosure concerns embodiments of a construction technique that can be used for modifying existing walls.

BACKGROUND

There are many structures in need of structural reinforcement or retrofitting to provide better insulation, waterproofing, a vapor barrier, and/or aesthetic properties. In some cases these are older structures whose designs or methods of construction are inadequate in light of present engineering standards and construction methods. In other cases these are new structures under construction that could benefit from the development of new methods of reinforcing and otherwise modifying existing designs.

Accordingly, it would be desirable to provide methods of modifying these walls in ways that provide greater strength, insulation, waterproofing, vapor-proofing, or aesthetics. One method of reinforcing such walls is disclosed in U.S. Pat. No. 6,662,516 B2, which describes a method of filling a double wall structure and methods of reinforcing a single wall structure with a foamable, adhesive material. Some of the methods described therein require the use of studs and in some cases the use of mechanical fasteners to secure the reinforcing materials to the existing wall. The use of studs in such methods can create thermal pathways which lead to energy losses through the wall and represent an additional cost. Similarly, the use of mechanical fasteners represents an additional cost and may create perforations in the reinforcing material, decreasing its insulation and waterproofing qualities. Thus, methods of modifying existing walls to provide a traditional wall surface without the use of studs or mechanical fasteners would be desirable.

SUMMARY

Disclosed herein are embodiments of an invention allowing the modification of existing walls. The disclosed methods can be applied to a wall of an old house or building or to a recently constructed existing wall of a house or building under construction. In some embodiments, a form assembly is provided with a form member facing an existing wall, to which sheathing panels are attached. The cavity created between the sheathing panels and the existing wall can be filled with a foamable, adhesive material which adheres to the sheathing panels and the existing wall and creates an adhesive connection between them. In some embodiments, the form assembly is vertically adjustable to facilitate the installation of multiple rows of sheathing panels. In some embodiments, the foamable, adhesive material is introduced in successive layers.

In one embodiment, a temporary form member can be positioned such that its inner surface is separated from and faces an existing wall. A sheathing panel can be temporarily secured to the form member and the cavity between the sheathing panel and the existing wall can be filled with a foamable, adhesive material which is allowed to cure. Thereafter, the temporary form member can be removed from the sheathing panel.

In another embodiment, a plurality of vertical posts can be positioned in a row along an existing wall. A vertically adjustable form member can be coupled to the vertical posts such that an inner surface of the form member is separated from and faces the existing wall. A sheathing panel can be temporarily secured to the inner surface of the form member and the cavity between the sheathing panel and the existing wall can be filled with a foamable, adhesive material which is allowed to cure. Thereafter, the temporary form member can be removed from the sheathing panel.

In yet another embodiment, a plurality of vertical posts can be spaced apart from each other in a row along the length of an existing wall. Vertical sliding members can be adjustably coupled to the vertical posts and upper and lower adjustable frame arms can be connected to the top and bottom, respectively, of the vertical sliding members. Thereafter, a form member can be connected to the upper and lower adjustable frame arms such that it is separated from and faces the existing wall.

DETAILED DESCRIPTION

Figure 1:
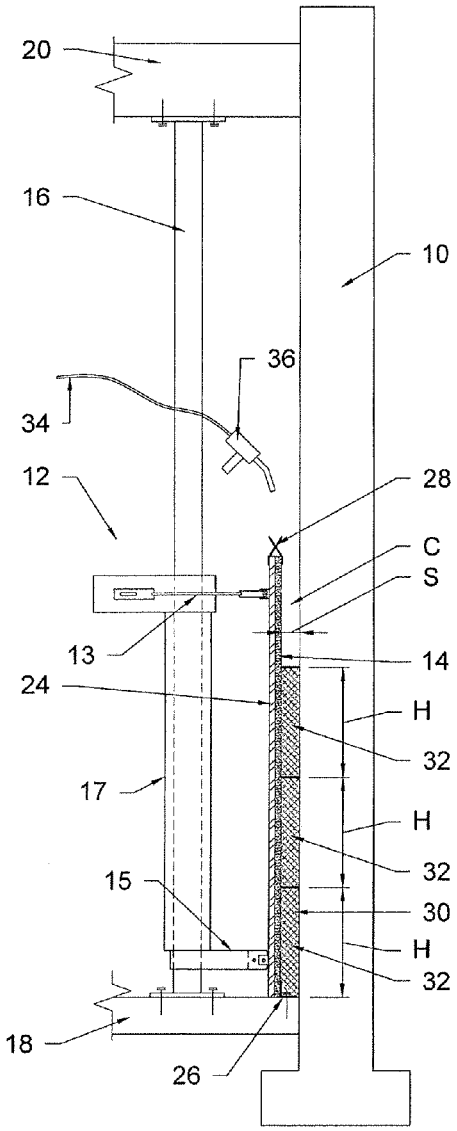
FIGS. 1 and 2 illustrate a method for securing a sheathing layer to an existing wall, according to one embodiment.

FIGS. 1-2 and 5-5A illustrate a method for securing a sheathing layer 8 to an existing wall 10. In particular embodiments, the sheathing layer 8 is secured to the wall 10 without any studs positioned in the cavity C between the sheathing layer and the wall. The method involves the use of a foamable, adhesive material to secure the sheathing layer to the wall. The foamable, adhesive material also serves as a vapor barrier and a waterproofing layer for the wall structure, and insulates the structure. The sheathing layer also provides a suitable wall surface to which various finishes can be applied (e.g., paint, texturing materials). The method has particular applicability for waterproofing a concrete wall or a masonry wall constructed from courses of masonry units (e.g., bricks, stones, concrete blocks, concrete masonry units, etc.), but can be used to modify a wall of any material. The existing wall can be a wall of an old structure (e.g., house or building) being renovated, or a recently built wall of a new structure being built. As such, the disclosed methods can be used for constructing new wall structures or for retrofitting existing wall structures.

The sheathing layer 8 can be formed from any of various known materials, such as plywood, gypsum board (drywall), composition board, OSB, hardy board, metal siding, or other forms of boarding known in the art. In particular embodiments, the sheathing layer is formed from standard sections, or panels 14 of gypsum board, which typically are manufactured and sold in 4 foot×8 foot panels, 4 foot×9 foot panels, 4 foot×10 foot panels, or 4×12 foot panels. Gypsum board is desirable because it provides a fire-resistant layer over the adhesive material that is used to secure the sheathing layer to the wall 10 and because gypsum board provides a suitable wall surface that can be finished with any of various decorative materials, such as paint, wall paper, etc. In the illustrated embodiment, the sheathing layer is installed on the interior surface of the existing wall 10. In other embodiments, a sheathing layer can be installed on the exterior surface and/or the interior surface of the existing wall.

Referring again to FIGS. 1-2 and 5-5A, the individual panels 14 of the sheathing layer 8 can be installed using a slip form assembly 12, which is configured to retain individual panels 14 in a vertical position spaced from the wall 10 such that a cavity C is formed between the sheathing panels 14 and the interior surface of the wall 10. In various embodiments, the width of this cavity is at about 2 inches, but can vary depending upon the particular application. In use, the slip form assembly 12 contacts the outer surface of a sheathing panel 14 being installed and provides resistance against the force exerted on the inner surface of the panel by the foamable material injected into the cavity C.

Figure 5:
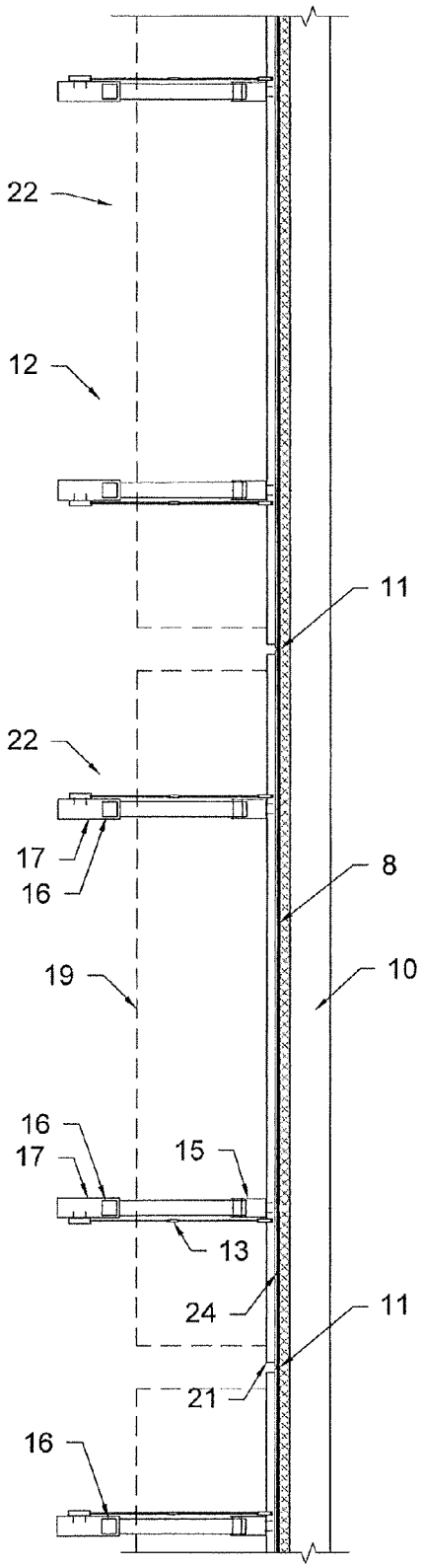
FIG. 5 illustrates from a top plan view a system for modifying an existing wall.

As illustrated in FIG. 5, the slip form assembly 12 can comprise a plurality of vertical posts 16 that are spaced horizontally from each other along a straight line spaced apart from the interior of the wall 10. Each post 16 can extend the height of the room and can be secured at its lower end to the floor 18 and at its upper end to the ceiling 20. Any of various suitable fasteners (e.g., nails, screws, etc.) can be used to temporarily secure the posts in place relative to the floor and the ceiling. For relatively tall walls (e.g., walls that are about 30 feet or greater in height between the floor and the ceiling), the posts can be reinforced with temporary wire ties or struts that secure the posts to the existing wall 10.

As illustrated in FIG. 5, a pair of support posts 16 can be provided for every sheathing panel 14. Mounted to each pair of vertical posts 16 is a movable slip form frame 22, which includes a respective vertical sliding member 17 on each post 16, a vertically disposed form member 24, a form frame 21, a pair of upper frame arms 13 and a pair of lower frame arms 15. Each vertical sliding member 17 is configured to slide vertically along a vertical post 16, and is connected at its upper end to an upper frame arm 13, and at its lower end to a lower frame arm 15. The upper and lower frame arms are connected to a respective form frame 21, which is connected to a vertically disposed form member 24. In this configuration, the form member 24 is rigidly supported by and vertically movable with the vertical sliding members 17, which are in turn supported on a pair of vertical posts 16. FIG. 1 shows the slip form frame 22 in its lowermost position and configured for the installation of the lowermost row 9*a* of panels 14. The slip form frame 22 can be raised vertically relative to the support posts 16 as the rows of panels 14 are installed one on top of another, as illustrated in FIG. 2, and as further described below.

Each sheathing panel 14 can be a conventional 4 foot×12 foot piece of drywall, and each form member 24 can have an overall size (length and height) that is about the same as the size of the panels 14. For example, when installing 4 foot×12 foot panels, the form member 24 can have a height of about 4 feet and a length of about 12 feet. In the embodiment illustrated in FIG. 5, each sheathing panel 14 and corresponding form member 24 is 12 feet wide, and each form frame 21 is 11 feet 10 inches wide, leaving two inches of clearance between neighboring form frames 21. As illustrated, for a 12-foot sheathing panel 14, the paired support posts 16 can be spaced 6 feet 8 inches apart, leaving 5 feet 4 inches separating posts of adjacent pairs.

Figure 2:
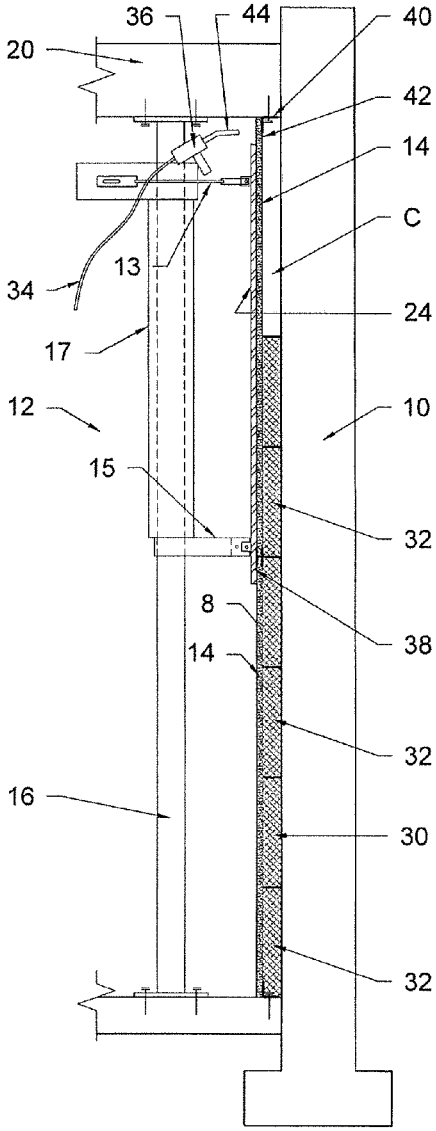
Figure 5A:
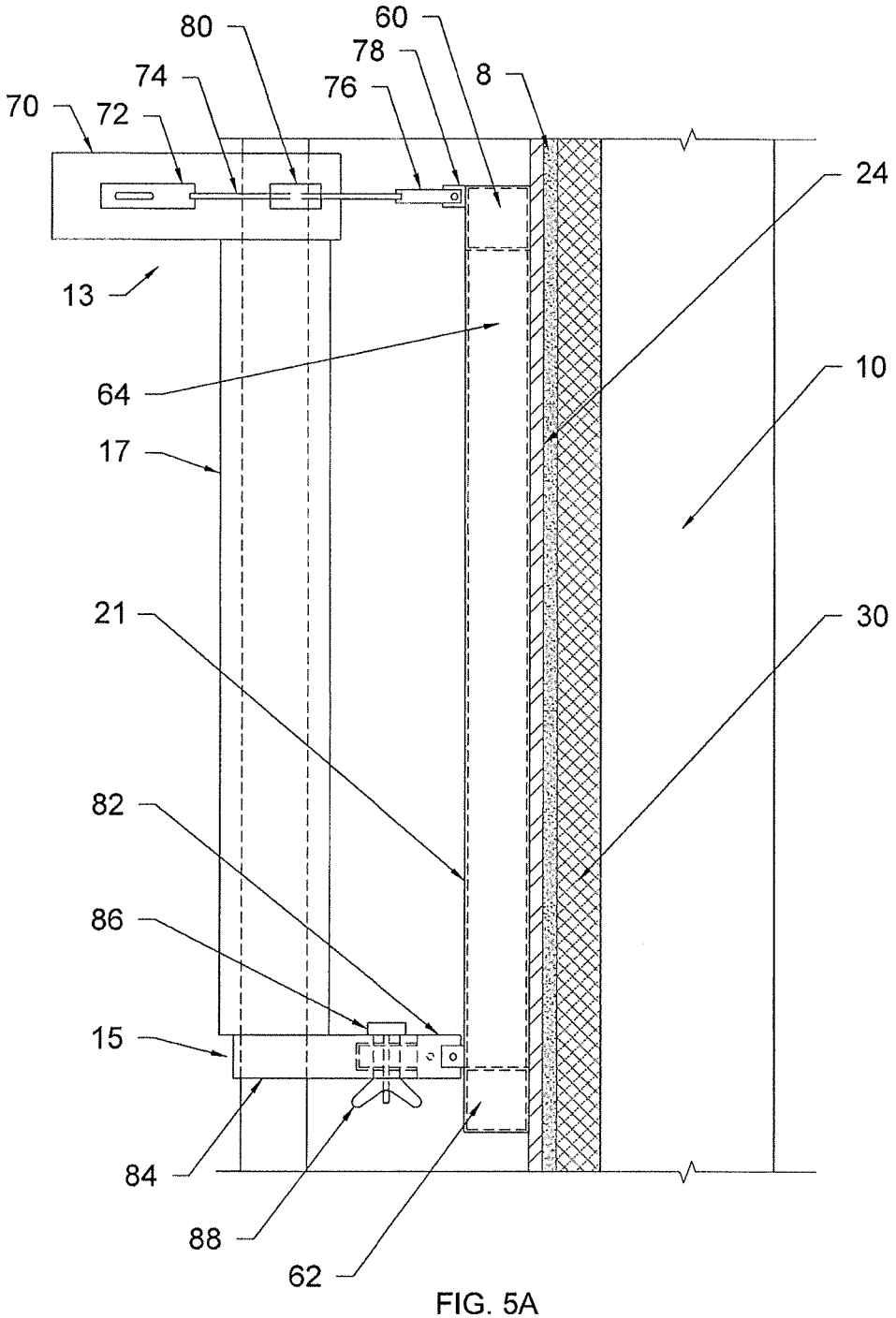
FIG. 5A illustrates from a side view a system for modifying an existing wall.

In FIGS. 1-2, the form member 24 is connected directly to the pair of upper frame arms 13 and the pair of lower frame arms 15. Alternatively, the form member 24 can be supported on a form frame 21, which is in turn supported by the pair of upper frame arms 13 and the pair of lower frame arms 15, as illustrated in FIGS. 5-5A. The form frame 21 can comprise an upper, horizontally disposed elongate tubular member 60 extending between a pair of upper frame arms 13, and a lower, horizontally disposed elongate tubular member 62 extending between a pair of lower frame arms 15, each extending horizontally along the length of the wall 10. The form frame can further comprise a plurality of vertically disposed tubular members 64 extending between the upper tubular member 60 and the lower tubular member 62, and spaced apart from each other at regular intervals. In this configuration, the form frame resembles a ladder extending along and facing the wall, with the vertical tubular members 64 representing rungs of the ladder. Use of the intermediate form frame 21 can be advantageous to increase the rigidity of the form member 24 in cases where the form member 24 comprises a relatively flexible material, e.g., plywood.

In some embodiments, the upper and lower frame arms are configured to permit adjustment of the position of the form member 24 relative to the wall 10 and therefore the size of the cavity. For example, as illustrated in FIG. 5A, the upper frame arm 13 can comprise a first plate 70 connected to the upper end of the vertical sliding member 17 and a second plate 78 connected to the upper end of the form frame 21. A first angle iron, or bracket, 72 can be bolted or otherwise secured to the first plate 70 and a second angle iron, or bracket, 76 can be bolted or otherwise secured to the second plate 78. A threaded rod 74 can be welded to the first and second angle irons, thereby completing the upper arm 13. In some embodiments the upper frame arm may also be provided with a turnbuckle 80 connecting two sections of the threaded rod 74 for adjusting the length of the upper frame arm 13, in which case the two sections of threaded rod can be threaded into brackets 72 and 76. In some embodiments, the lower frame arm 15 comprises a first slotted tube 82 having an outside diameter slightly smaller than the inside diameter of a second slotted tube 84 so that the first slotted tube 82 can be inserted into the second tube in a telescoping manner. By inserting the first slotted tube into the second so that their slots align and sliding one slotted tube with respect to the other, the length of the lower frame arm 15 may be adjusted. By providing a bolt 86 through the slots in both tubes and tightening it with a wing-nut 88, the lower frame arm 15 may be secured and may be provided with strength sufficient to be walked on. The first slotted tube 82 may be connected to the form frame 21 and the second slotted tube may be connected to the vertical sliding member 17 by any suitable techniques or mechanisms, such as bolts, welding, etc. In this configuration, the adjustable nature of the upper and lower frame arms allows rapid changes in the width of the cavity and provides a simple method for achieving proper orientation of the sheathing panels during construction.

Because the foil member 24 comes in direct contact with the sheathing layer, the form member 24 desirably has a surface that minimizes sliding friction with the outer surface of the sheathing layer when the form member is raised to a higher elevation for installing the next row of panels 14. For example, the form member 24 can comprise a metal or metal clad form, or a base layer (e.g., metal) having a low friction polymeric layer or coating made of PTFE (polytetrafluoroethylene) or HDPE (high-density polyethylene). The low friction surface allows the form member 24 to slide upwardly relative to a panel 14 of the sheathing layer after it has been installed.

The form assembly 12 can be provided with releasable securement devices that secure the frame 22 at selected positions along the height of the support posts 16 for installing each row of panels 14. The securement devices can be, for example, removable pins that extend into openings in the support posts 16 and corresponding openings in the sliding frame 22.

A plurality of slip form assemblies 12 can be provided, on which plural form members 24 can be mounted end-to-end such that a form extends along the entire length of the wall 10. In this configuration, a row of panels 14 extending the entire length of the wall 10 can be positioned adjacent the wall 10 at the same time and secured in place with continuous layers of adhesive material extending the length of the wall in the cavity C. After each row of panels is formed, the frames 22 and respective form members 24 are raised to install the next row of panels 14 above the previously formed row of panels.

In certain applications, such as when installing a sheathing layer on a relatively long wall, the frames 22 and form members 24 need not extend the entire length of the wall. In such cases, a complete row of panels 14 extending the length of the wall can be installed in sections that extend less than the length of the wall. When forming a partial row of panels, the exposed end of the cavity C can be covered with a layer of material to retain the adhesive material in the cavity.

Figure 3:
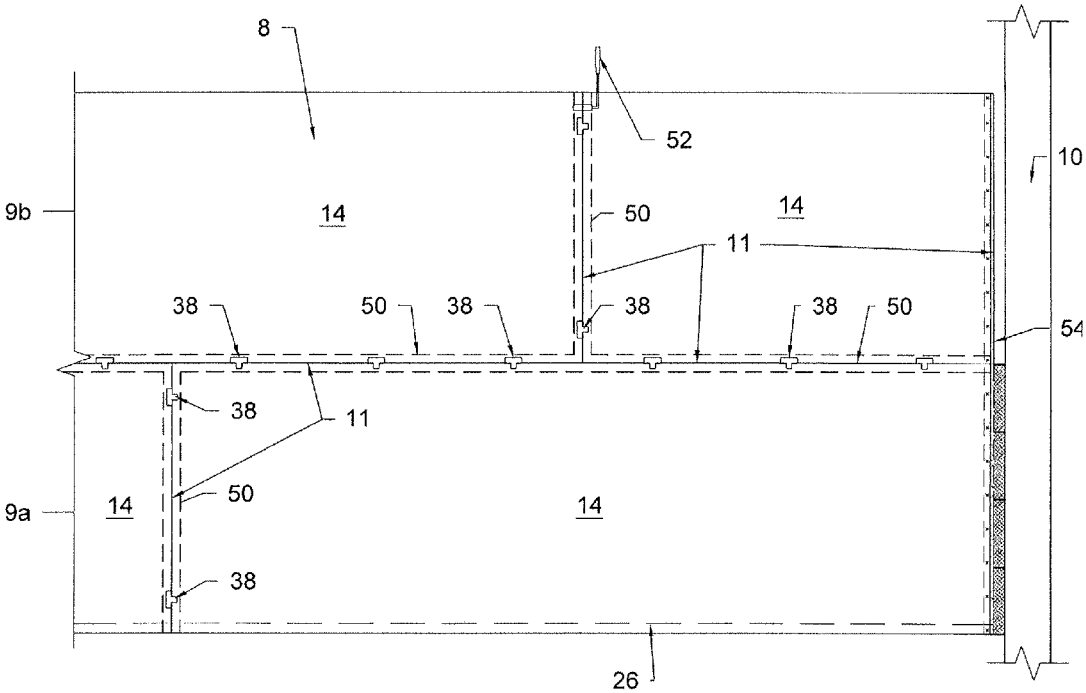

Prior to placing the lowermost row of panels 14 on the slip form assembly 12, a starter clip 26 can be secured to the floor at the location where the lowermost row of panels 14 is to be installed. The clip 26 can be an L-shaped bracket or angle bracket that extends the entire length of the wall or at least partially along the length of the wall at the intersection of the floor and the lower edges of the panels 14. The clip 26 helps prevent the panels from sliding inwardly toward the wall. As shown in FIG. 1, the upper edge of the panel 14 can be temporarily secured to the upper edge of the form 24, such as with one or more spring clips or clamps 28 spaced along the upper edge of the form 24. As shown in FIG. 3, one or more conventional ply clips 38 can be used to help align the adjacent vertical edges of adjacent panels 14 in the same row. A layer of tape 50 can be applied to the adjacent vertical edge portions of the panels 14 on their inner surface (inside the cavity) to help seal the abutting edges of the panels and prevent or at least minimize foam leaks. A roller device 52 can be used to apply the tape to the inner surface of the panels (inside the cavity). Alternatively, the tape 50 can be applied to the outer surface of the sheathing layer. At the corner of the sheathing layer, the vertical edges of the panels 14 can be secured to a vertical angle bracket 54.

After the lowermost row 9*a* of panels 14 is in place to form the cavity C, the cavity can be filled with the foamable, adhesive material 30 to bond the panels 14 to the existing wall 10. In particular embodiments, the cavity is filled with a plurality of layers 32 of the foamable, adhesive material 30. Desirably, the adhesive material 30 has the following characteristics: high adhesion to provide a strong bond between the walls; high compressive, tensile, and shear strength; and low expansion. The adhesive material 30 desirably is sufficiently elastic to adsorb energy transmitted to the wall structure caused by seismic activity, has a minimal set up or cure time, and produces minimal off gases harmful to those handling the adhesive material. The adhesive material 30 also may be selected to provide waterproofing for the wall structure to which the adhesive material is applied. Some examples of adhesive material that can be used include, without limitation, open or closed cell polyurethane foam, or other suitable materials. Closed cell foams are most desirable in that they are substantially impervious to water. A suitable polyurethane foam is SR Foam, a closed cell polyurethane foam available from SR Contractors (Portland, Oreg.). The adhesive material 30 desirably has a density from about 1 lb./ft.$^3$ to 10 lbs./ft.$^3$, and even more desirably from about 2 lbs./ft.$^3$ to 10 lbs./ft.$^3$ The adhesive material can be formed by mixing a resin base material stored in a first container with a conventional activating agent stored in a second container. In one example, the base material and activating agent are mixed in a one-to-one ratio. To form polyurethane foam, such as described above, the base material would be a polyurethane resin. The base material may contain surfactants, fire retardants, a blowing agent and other additives. The density of the adhesive material 30 introduced into the cavity can be varied by starting with a base material of a different formulation, typically by varying the amount of activating agent in the formulation.

Pumps (not shown) in the first and second containers pump the resin base material and activating agent, respectively, through respective hoses (not shown) into a proportioning unit (not shown). The proportioning unit pumps the base material and the activating agent at about 1000 psi through respective hoses 34 to a spray gun, or nozzle, 36 wherein the base material is mixed with the activating agent. The proportioning unit and the hoses desirably have heating coils to preheat the base material and activating agent to about 120 degrees F. When the materials mix in the spray gun 36, the activating agent triggers an exothermic chemical reaction, the product of which is the adhesive foam material 30 typically having an initial temperature of about 140 degrees F. During this early exothermic stage, the foam is in a viscous seam-like state and can be poured into the cavity. Once in the cavity the foam flows and expands to fill the cavity. The slip form assembly 12 holds the panels 14 in place against the force exerted by the expanding foam.

The nozzle 36 is moved longitudinally along the bottom of the cavity to form an even layer 32 of material of a height H. After the adhesive material is sprayed into the cavity to form the bottommost layer 32, the end of the nozzle 36 is raised a sufficient distance so as to avoid contact with the expanding adhesive material, which is allowed to cure before another layer of adhesive material is formed on the bottommost layer 32. Preferably, the adhesive material is cured until it expands at only a minimal rate (e.g., the adhesive material has expanded to about 99 percent of its expanded state), or more even preferably, to a point where the adhesive material no longer expands. The cure time is a function of the foam density. For example, the cure time for a foam density of 2 lbs./ft.$^3$ is about 4 minutes while the cure time for a foam density of 10 lbs./ft.$^3$ may be longer. Once the adhesive material has substantially cured, the end of the nozzle 36 is positioned at a point just above the previously formed, bottommost layer 32 and adhesive material is sprayed on top of the bottommost layer as the nozzle is moved longitudinally along the cavity so as to form an additional layer of adhesive material. The layering process is then repeated until the cavity is filled with layers having substantially the same height H (as illustrated in FIG. 1). In particular embodiments, the height H of each layer 32 is about 6 inches to about 48 inches, with about 12 inches being a specific example. Additional details regarding the foamable material 30 and the technique for forming successive layers in the cavity are provided in U.S. Pat. No. 6,662,516, which is incorporated herein by reference.

After filling the cavity and allowing the adhesive material to cure, another row 9*b* of panels 14 can be installed above the previously installed row 9*a* of panels. To install the next row of panels, the clips 28 are removed from the form 24, and the frame 22 and the form member 24 are raised to a new position above the previously installed row 9*a*, as depicted in FIG. 2. The panels 14 of row 9*b* are positioned such that their lower longitudinal edges abut the upper edges of the panels below. As best shown in FIG. 3, one or more conventional ply clips 38 can be placed along the upper edges of the lower panels and the lower edges of the upper panels to assist in aligning the panels of the adjacent rows. The abutting longitudinal edge portions of the panels can be covered with a layer of tape 50 (which can be placed on either the inner or the outer surface of the panels). After a cavity is formed between the row 9*b* of the panels and the wall 10, the cavity can be filled with the adhesive material 30, in the manner described above. The process of raising the frame 22 and the form 24, installing a new row of panels, and filling the cavity with the adhesive material 30 can be repeated as needed until the uppermost panel is installed.

When installing the uppermost row of panels adjacent the ceiling 20, an upper angle bracket 40 can be secured to the ceiling to assist in supporting the upper edges of the panels 14 in the uppermost row (see FIG. 2). In order to inject the foamable material 30 into the cavity, a series of small holes 42, large enough to receive the distal end portion 44 of the nozzle, can be formed along the upper edge portion of the panel 14. The distal end portion 44 of the nozzle 36 can be inserted into the various holes 42 for forming layers 32 of adhesive material 30 filling up the cavity C between the wall 10 and the uppermost row of panels 14.

Advantageously, the adhesive material 30 secures the panels of the sheathing layer to the wall 10 without any studs or mechanical fasteners, such as nails or screws. The layers of material 30 also function as a water and air barrier for the wall structure such that traditional wall waterproofing is not required. The adhesive material 30 also insulates the wall structure and further reduces energy losses by eliminating the thermal transfer pathways of furring studs. After the sheathing layer is installed, the slip form assembly 12 can be converted into a movable platform 19 for use in finishing the outer surface of the sheathing layer (e.g., painting the sheathing layer). For example, the frame 22 and the form 24 can be placed in a horizontal position to allow a worker to sit or stand on the form 24 when applying a finish to the sheathing layer. Further, in some embodiments, the seams where sheathing panels 14 meet may be sealed with a sealant 11, such as an epoxy or a polyurethane foam, with one specific example being the Hilti CF 812 Window and Door Low-Pressure Filler Foam. The sealant 11 between panels 14 may be applied to vertical seams within rows of sheathing panels 14, as well as horizontal seams between rows. Thereafter, the slip form assembly 12 can be removed.

Figure 4:
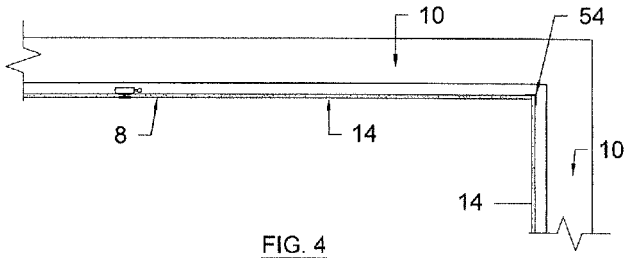
FIGS. 3 and 4 are front elevation and top plan views, respectively, of a completed wall structure comprising a sheathing layer mounted to the interior surface of an existing wall.

FIGS. 3 and 4 are front elevation and top plan views, respectively, of a completed wall structure comprising a sheathing layer 8 mounted to the interior surface of the wall 10. As shown in FIG. 3, the sheathing layer 8 comprises a plurality of rows 9*a*, 9*b*, etc. of panels 14 extending the length of the wall 10. Of course, the number of rows of panels will depend on the height of the wall 10 and the dimensions of the sheathing panels 14.

Figure 6:
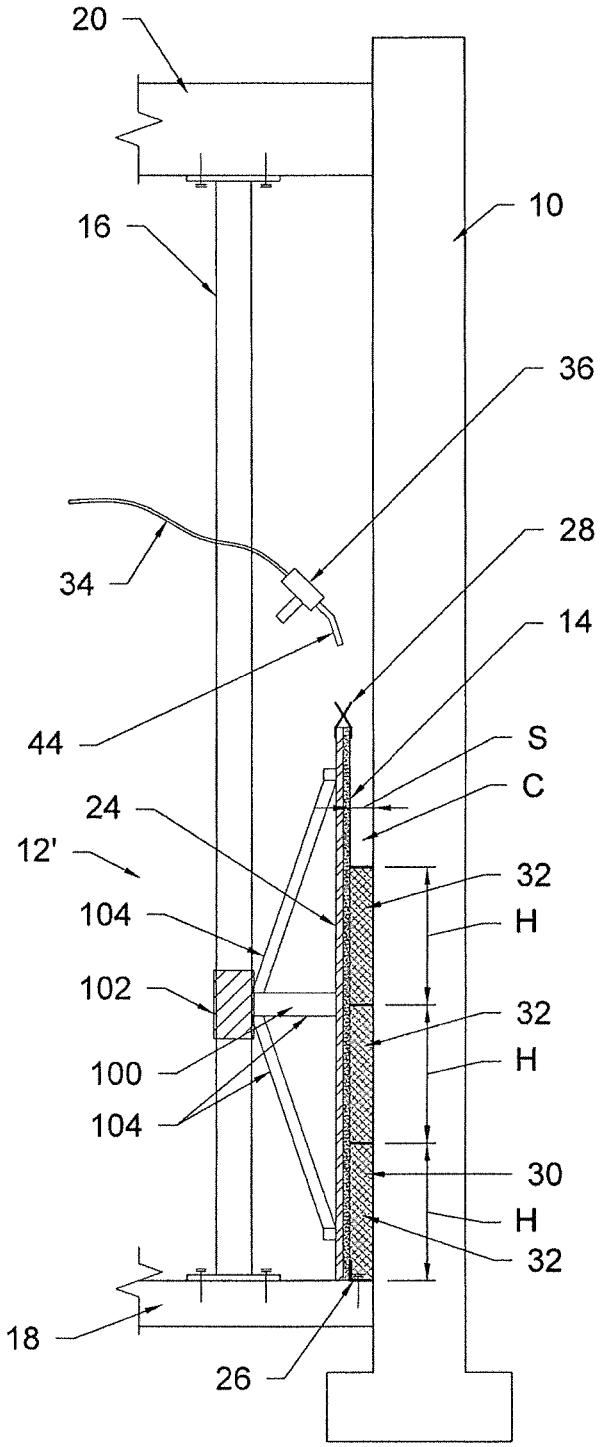
FIGS. 6 and 7 illustrate a method of securing a sheathing layer to an existing wall, according to one embodiment.
Figure 7:
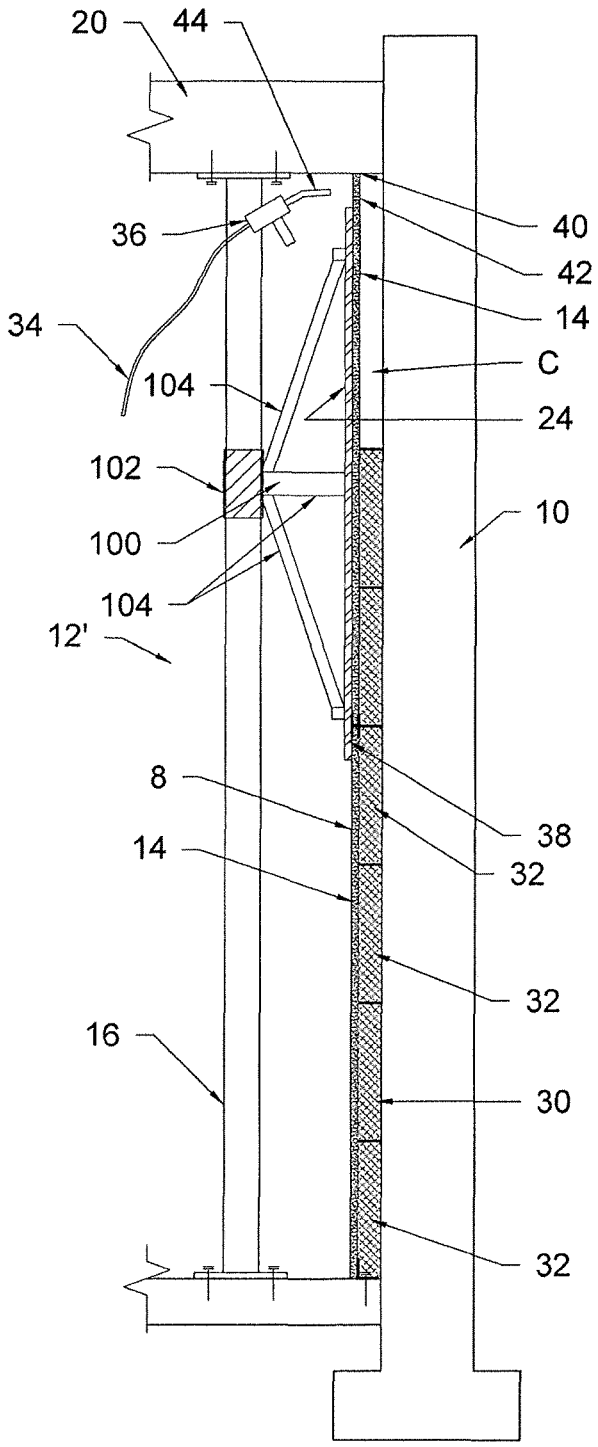

FIGS. 6 and 7 illustrate a method for securing a sheathing layer 8 to an existing wall 10, using a frame assembly 12' of a different construction. As illustrated, the frame assembly 12' comprises a slip form frame 100 having a vertical sliding member 102, three connecting members 104, and a form member 24. The vertical sliding member 102 is mounted to one or more vertical posts 16 for vertical movement (upwardly and downwardly) relative to support posts 16. The three connecting members 104 are each attached to the sliding member 102 at one end and to the form member 24 at the other. This arrangement rigidly connects the form member 24 to the sliding member 102 and allows the form member 24 to be adjusted up and down as the sliding member 102 moves along the support posts 16. FIG. 6 shows the slip form frame 100 in its lowermost position, for installation of the lowermost row 9*a* of sheathing panels 14. The slip form frame 100 can be raised vertically relative to the support posts 16 to install another row 9*b* of sheathing panels 14, as shown in FIG. 7.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A method for modifying an existing wall comprising:

positioning a temporary form member such that an inner surface of the temporary form member faces the existing wall and is separated from the existing wall by a distance;

temporarily securing at least one sheathing panel to the inner surface of the form member, thereby creating a cavity between the sheathing panel and the existing wall;

filling the cavity between the at least one sheathing panel and the existing wall with a foamable, adhesive material, and allowing the foamable, adhesive material to cure, thereby adhesively securing the sheathing panel to the existing wall; and removing the temporary form member from the sheathing panel.

2. The method of claim 1, further comprising:

after removing the temporary form member from the sheathing panel, vertically adjusting the temporary form member so the temporary form member is positioned above the sheathing panel;

temporarily securing another sheathing panel, unconnected with the sheathing panel, to the inner surface of the form member, thereby creating a cavity between the another sheathing panel and the existing wall;

filling the cavity between the another sheathing panel and the existing wall with a foamable, adhesive material, and allowing the foamable, adhesive material to cure, thereby adhesively securing the another sheathing panel to the existing wall; and removing the temporary form member from the another sheathing panel.

3. The method of claim 2, wherein the another sheathing panel is adhesively secured to the existing wall in a position such that a lower edge of the another sheathing panel is in contact with an upper edge of the sheathing panel.

4. The method of claim 1, wherein filling the cavity comprises:

forming a first layer of the foamable, adhesive material along a bottom of the cavity;

allowing the first layer of the foamable, adhesive material to expand;

forming at least a second layer of the foamable, adhesive material along a top of the expanded first layer of the foamable, adhesive material; and allowing the second layer of the foamable, adhesive material to expand.

5. A method for modifying an existing wall comprising:

positioning a plurality of vertical posts spaced apart from each other in a row along the length of the existing wall;

coupling to the vertical posts at least one vertically adjustable form member having an inner surface that faces the existing wall and is separated from the existing wall by a distance;

temporarily securing a sheathing panel to the inner surface of the form member, thereby creating a cavity between the sheathing panel and the existing wall;

filling the cavity between the sheathing panel and the existing wall with a foamable, adhesive material, and allowing the foamable, adhesive material to cure, thereby adhesively securing the sheathing panel to the existing wall; and removing the form member from the sheathing panel.

6. The method of claim 5, wherein the positioning of the plurality of vertical posts is accomplished by securing each post to a floor and to a ceiling adjacent the existing wall.

7. The method of claim 5, wherein the inner surface of the form member has a total area that approximates that of the sheathing panel temporarily secured thereto.

8. The method of claim 5, wherein filling the cavity comprises:

forming a first layer of the foamable, adhesive material along a bottom of the cavity;

allowing the first layer of the foamable, adhesive material to expand;

forming at least a second layer of the foamable, adhesive material along a top of the expanded first layer of the foamable, adhesive material; and allowing the second layer of the foamable, adhesive material to expand.

9. The method of claim 5, wherein the adhesively securing of the sheathing panel to the existing wall is accomplished without using a mechanical fastener to fasten the sheathing panel to the existing wall.

10. The method of claim 5, further comprising:

forming a series of small holes along an upper portion of the sheathing panel; and filling the cavity between the sheathing panel and the existing wall through the series of small holes.

11. The method of claim 5, wherein the sheathing panel comprises a material selected from the group consisting of: plywood, gypsum board, drywall, composition board, OSB, hardy board, and metal siding.

12. The method of claim 5, wherein the foamable, adhesive material comprises an open or a closed cell polyurethane foam.

13. The method of claim 5, wherein the width of the cavity is at least two inches.

14. The method of claim 5, wherein the inner surface of the form member has a lower coefficient of friction than the surface of the sheathing panel.

15. The method of claim 14, wherein the inner surface of the form member comprises PTFE (polytetraflouroethylene) or HDPE (high density polyethylene).

16. The method of claim 5, further comprising:

after removing the form member from the sheathing panel, vertically adjusting the form member so the form member is positioned above the sheathing panel;

temporarily securing another sheathing panel, unconnected with the sheathing panel, to the inner surface of the form member, thereby creating a cavity between the another sheathing panel and the existing wall;

filling the cavity between the another sheathing panel and the existing wall with a foamable, adhesive material, and allowing the foamable, adhesive material to cure, thereby adhesively securing the another sheathing panel to the existing wall; and removing the form member from the another sheathing panel.

17. The method of claim 16, wherein the another sheathing panel is adhesively secured to the existing wall in a position such that a lower edge of the another sheathing panel is in contact with an upper edge of the sheathing panel.

* * * * *